US008382102B2

(12) United States Patent
Imae

(10) Patent No.: US 8,382,102 B2
(45) Date of Patent: Feb. 26, 2013

(54) TRANSPORTATION ALIGNMENT DEVICE, CONTROL METHOD FOR A TRANSPORTATION ALIGNMENT DEVICE, AND RECORDING DEVICE

(75) Inventor: Toshihiro Imae, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 12/843,101

(22) Filed: Jul. 26, 2010

(65) Prior Publication Data

US 2011/0024976 A1 Feb. 3, 2011

(30) Foreign Application Priority Data

Jul. 31, 2009 (JP) ..... 2009-178696

(51) Int. Cl.
*B65H 9/04* (2006.01)

(52) U.S. Cl. ..... 271/245; 271/265.03; 271/226

(58) Field of Classification Search ..... 271/245, 271/246, 247, 248, 226, 265.03
See application file for complete search history.

(56) References Cited

U.S. PATENT DOCUMENTS 3,843,264 A * 10/1974 Josse et al. ..... 356/429
4,237,539 A * 12/1980 Piovoso et al. ..... 702/35
5,918,877 A * 7/1999 Takei et al. ..... 271/261
7,635,123 B2 * 12/2009 Watanabe et al. ..... 271/9.09
2009/0085284 A1 * 4/2009 Tsuruoka ..... 271/265.04

FOREIGN PATENT DOCUMENTS

JP 63-147744 A 6/1988
JP 03-094275 A 4/1991
JP 04-334470 A 11/1992
JP 09-039322 A 2/1997
JP 2003-291443 A 10/2003

* cited by examiner

*Primary Examiner* — Michael McCullough
*Assistant Examiner* — Howard Sanders
(74) *Attorney, Agent, or Firm* — Nutter McClennen & Fish LLP; John J. Penny, Jr.

(57) ABSTRACT

A transportation alignment device, a control method for a transportation alignment device, and a recording device determine the alignment of media having a transparent part with high transmittance at its leading end with a simple configuration, and prevent idling of processes downstream from the alignment member. A plurality of optical media detection sensors arranged across the width of the transportation path on the upstream side of the alignment plates each detect a medium touching the alignment plates. If all of the media detection sensors do not detect the medium when the medium has been advanced sufficiently to contact the alignment plate and align the medium, a medium, such as a laminated medium, having a high transmittance part at the leading end thereof is determined to be aligned, the alignment plate is retracted from the transportation path, and the medium is conveyed to the downstream side of the transportation path.

16 Claims, 6 Drawing Sheets

TRANSPORTATION ALIGNMENT DEVICE, CONTROL METHOD FOR A TRANSPORTATION ALIGNMENT DEVICE, AND RECORDING DEVICE

Priority is claimed under 35 U.S.C. §119 to Japanese Application No. 2009-178696 filed on Jul. 31, 2009, which is hereby incorporated by reference in its entirety.

BACKGROUND

1. Technical Field

The present invention relates to technology for conveying media that is aligned by using an alignment member.

2. Related Art

Recording devices having a transportation means that conveys a medium, and a recording head that records an image of text or other content on the conveyed medium, are known from the literature. See, for example, Japanese Unexamined Patent Appl. Pub. JP-A-H09-39322. So that the medium is not skewed as it passes the recording head, such recording devices have an alignment member that can move to a forward position where the medium enters the transportation path, and a retracted position where the alignment member is retracted from the transportation path, and advance the leading edge of the medium to this alignment member to align the medium.

This type of recording device must accurately determine if the medium has been aligned by the alignment member, therefore has a plurality of optically transparent media detection sensors on the upstream side of the alignment member, and determines whether or not the medium is aligned based on the output of these media detection sensors. More specifically, the medium is determined to have been aligned by the alignment member if the medium is detected by at least two adjacent media detection sensors, but is determined to be conveyed through the transportation path in a skewed position if the medium is detected by only one media detection sensor. Whether or not the medium has been aligned by the alignment member can therefore be determined easily and accurately.

This configuration using transparent media detection sensors can easily determine if common paper media is aligned. However, if the medium has an area with high optical transmittance at its leading end (edge part) similarly to a laminated medium, light will pass through this transparent part. As a result, even if such a medium is aligned and touching the alignment member, the media detection sensors cannot determine that the medium is aligned and processes downstream from the alignment member remain idle. To solve this problem, a sensor for determining if such a laminated medium is aligned can conceivably be added, but this configuration requires a design change and inevitably results in increased cost.

SUMMARY

A transportation alignment device, a control method for a transportation alignment device, and a recording device according to the present invention can determine the alignment of media having a transparent part with high transmittance at its leading end by means of a simple configuration, and can prevent idling of processes downstream from the alignment member.

A first aspect of at least one embodiment of the invention is a transportation alignment device having a transportation means that conveys a medium, and an alignment member that can move to a forward position intervening in a transportation path of the medium and a retracted position retracted from the transportation path, the transportation alignment device causing the leading end of the medium to contact the alignment member and align the medium, and including a plurality of optical media detection sensors arranged across the width of the transportation path on the upstream side of the alignment member and each detecting a leading end part of the medium touching the alignment member; and a control means that, when the medium is conveyed a specific amount sufficient to contact the alignment member and align the medium and all of the media detection sensors do not detect the medium, determines the medium is a medium having an edge part with higher transmittance than the part other than the edge part, and controls retracting the alignment member from the transportation path and conveying the medium to the downstream side of the transportation path.

When the medium is conveyed a specific amount sufficient to make the medium contact the alignment member and align the medium, and all of the media detection sensors do not detect the medium, this aspect of at least one embodiment of the invention can determine that a medium having a part with high transmittance at the leading end thereof is aligned. As a result, alignment of the medium can be determined using a simple configuration when the medium is plain paper and when a medium that has been laminated. In addition, because operation is controlled so that the alignment member is retracted from the transportation path and the medium is conveyed to the downstream side of the transportation path when it is determined that a medium having a part with high transmittance at its leading end is aligned, idling of processes downstream from the alignment member can be prevented.

A transportation alignment device according to another aspect of at least one embodiment of the invention preferably has an optical scanning unit that optically reads a surface of the medium at a position on the transportation path downstream from the alignment position of the alignment member, and the control means reads a surface of the medium by means of the optical scanning unit.

Because this aspect of at least one embodiment of the invention conveys the medium to the optical scanning unit and reads a surface of the medium by means of the optical scanning unit when it is determined that a medium having a part with high transmittance at its leading end is aligned, the continuous operation of aligning and scanning can be executed quickly.

A transportation alignment device according to another aspect of at least one embodiment of the invention preferably also has an optical scanning unit that optically reads a surface of the medium at a position on the transportation path downstream from the alignment position of the alignment member, and when the medium is conveyed a specific amount sufficient to align the medium in contact with the alignment member and only one of the media detection sensors detects the medium, the control means controls retracting of the alignment member from the transportation path and conveying of the medium to the downstream side of the transportation path, reading a surface of the medium by means of the optical scanning unit, and determining based on the captured image if the medium is aligned.

Because this aspect of at least one embodiment of the invention conveys the medium to the optical scanning unit and determines whether or not the medium is aligned based on the image captured by the optical scanning unit when only one of the media detection sensors detects the medium, that is, when the medium would be determined to be skewed by the related art, the reason why the medium is detected by only one sensor, such as because the medium is actually skewed or because the medium is laminated and transmittance is reduced because part of the leading end is soiled, can be accurately determined. The detection accuracy of the media detection sensor therefore does not need to be made higher than necessary, and the device configuration and the alignment detection process can be simplified.

When only one media detection sensor detects the medium, the control means in another aspect of at least one embodiment of the invention drives the transportation means and repeats medium alignment a specific number of times.

Because slight skewing of the medium can be eliminated by driving the transportation means, this aspect of at least one embodiment of the invention can quickly execute the alignment process.

A transportation alignment device according to another aspect of at least one embodiment of the invention also has a recording means that records an image on the medium at a position on the transportation path downstream from the alignment position of the alignment member, and when the medium is aligned, the control means permits recording an image on the medium by the recording means.

Because this aspect of at least one embodiment of the invention permits recording an image on the medium when the medium is aligned, this aspect of at least one embodiment of the invention can easily record an image on the medium even when the medium is laminated by, for example, rendering a recordable area on the medium. In addition, because an image is not recorded on the medium when the medium is conveyed skewed, errors recording images on the medium can be prevented.

Another aspect of at least one embodiment of the invention is a control method for a transportation alignment device that has a transportation means that conveys a medium, and an alignment member that can move to a forward position intervening in a transportation path of the medium and a retracted position retracted from the transportation path, and causes the leading end of the medium to contact the alignment member and aligns the medium, wherein the control method: detects a leading end part of the medium touching the alignment member with a plurality of optical media detection sensors arranged across the width of the transportation path on the upstream side of the alignment member when the medium is conveyed a specific amount sufficient to contact the alignment member and align the medium; and when all of the media detection sensors do not detect the medium, determines that the medium is a medium having an edge part with higher transmittance than the part other than the edge part, and controls retraction of the alignment member from the transportation path and conveying the medium to the downstream side of the transportation path.

Another aspect of at least one embodiment of the invention is a recording device having: a transportation means that conveys a medium; an alignment member that can move to a forward position intervening in a transportation path of the medium and a retracted position retracted from the transportation path; a recording means that records an image on the medium aligned by the alignment member; a plurality of optical media detection sensors arranged across the width of the transportation path on the upstream side of the alignment member and each detecting a leading end part of the medium touching the alignment member; and a control means that, when the medium is conveyed a specific amount sufficient to contact the alignment member and align the medium and all of the media detection sensors do not detect the medium, determines the medium is a medium having an edge part with higher transmittance than the part other than the edge part, and controls retracting the alignment member from the transportation path and conveying the medium to the downstream side of the transportation path.

In a transportation alignment device according to another aspect of at least one embodiment of the invention, the media detection sensor includes a plurality of sensors arranged at equal intervals along the alignment member.

In a transportation alignment device according to another aspect of at least one embodiment of the invention, when two or more adjacent media detection sensors detect the medium, the medium is determined to be a paper medium and alignment of the paper medium by the alignment member is determined to be completed.

A transportation alignment device according to another aspect of at least one embodiment of the invention also has an insertion detection sensor that detects insertion of the medium to the transportation path, and when the insertion detection sensor detects the medium, the control means moves the alignment member into the transportation path, causes the leading end of the medium to contact the alignment member, and aligns the medium.

In a transportation alignment device according to another aspect of at least one embodiment of the invention, the media detection sensor includes a plurality of sensors arranged at equal intervals along the alignment member.

In a transportation alignment device according to another aspect of at least one embodiment of the invention, when two or more adjacent media detection sensors detect the medium, the medium is determined to be a paper medium and alignment of the paper medium by the alignment member is determined to be completed.

A transportation alignment device according to another aspect of at least one embodiment of the invention also has an insertion detection sensor that detects insertion of the medium to the transportation path, and when the insertion detection sensor detects the medium, the control means moves the alignment member into the transportation path, causes the leading end of the medium to contact the alignment member, and aligns the medium.

Effect of at Least One Embodiment of the Invention

When the medium is conveyed a specific amount sufficient to make the medium contact the alignment member and align the medium, and all of the media detection sensors do not detect the medium, this aspect of at least one embodiment of the invention can determine that a medium having a part with high transmittance at the leading end thereof is aligned. As a result, alignment of the medium can be determined using a simple configuration even if the medium is laminated. In addition, because operation is controlled so that the alignment member is retracted from the transportation path and the medium is conveyed to the downstream side of the transportation path when it is determined that a medium having a part with high transmittance at its leading end is aligned, idling of processes downstream from the alignment member can be prevented.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
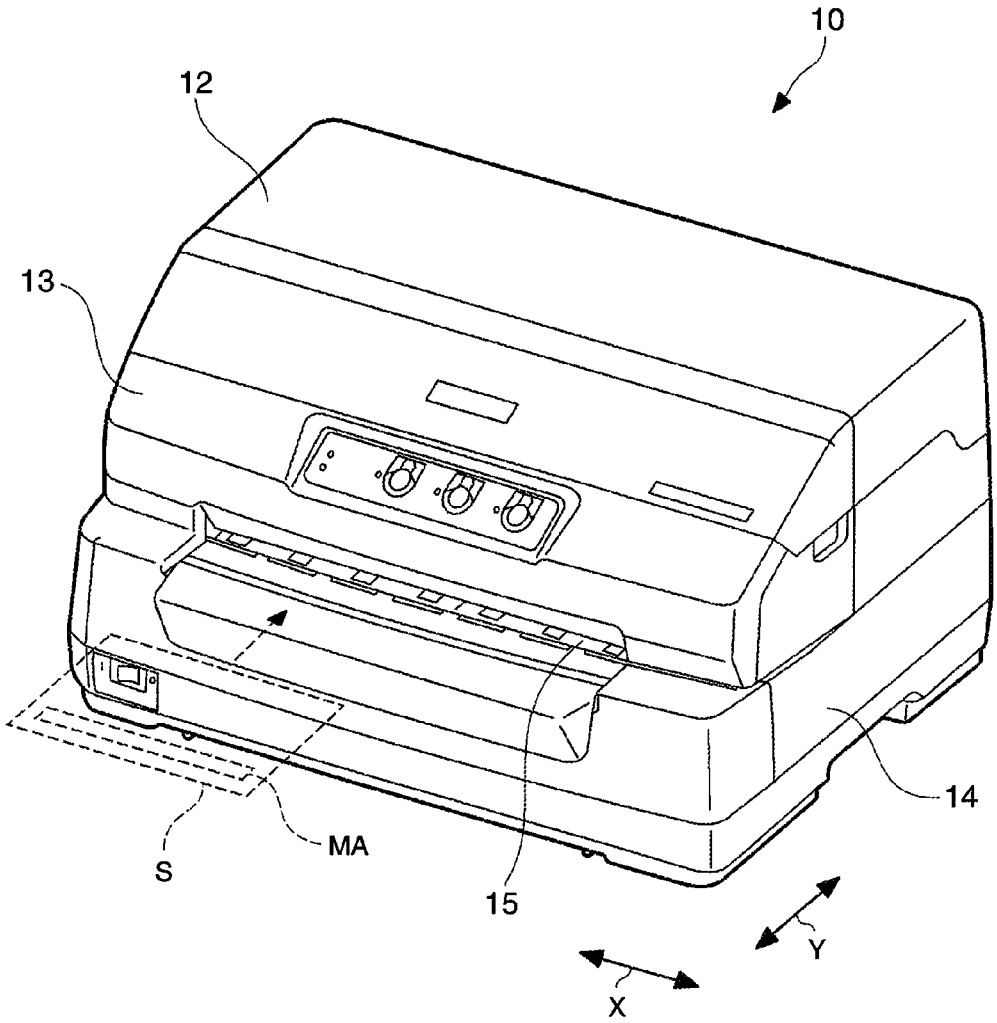
FIG. 1 is an external view of a dot impact printer according to a preferred embodiment of the invention.

The dot impact printer 10 shown in FIG. 1 pushes a plurality of recording wires disposed on the recording head (recording means) 18 (see FIG. 3) against the recording medium (medium) S with an ink ribbon (not shown in the figure) delivered from a ribbon cartridge (not shown in the figure) therebetween to form dots on the recording surface of the recording medium S and thereby record an image, which may include text.

Recording media S that can be used with the dot impact printer 10 include media that is cut to a specific length, and continuous paper including plural connected sheets. Cut-sheet media include individual slips and multipart forms, as well as passbooks, postcards, and envelopes, for example. Continuous paper also includes continuous multipart forms paper.

This embodiment of the invention is described using checks or promissory notes (collectively referred to as simply "checks" below) issued by financial institutions as an example of the recording medium S. A check as used herein is a slip on the surface of which MICR (magnetic ink character recognition) information such as the account number of the user and a serial check number are printed in magnetic ink in a known MICR area MA.

In addition to checks, a passbook can also be used as the recording medium S with this dot impact printer 10. A passbook has plural pages of recording paper bound in book form, and the exposed inside surface of the open passbook is the recording surface. A magnetic stripe is disposed on the back surface of the leaves corresponding to the front and back covers of the passbook.

As shown in FIG. 1, the dot impact printer 10 has a top cover 12, a top case 13, and a bottom case 14 as an outside housing with a manual insertion opening 15 for inserting and discharging the recording medium S in the front of the top case 13 and bottom case 14. The side where this manual insertion opening 15 opens, that is, the left side as seen in FIG. 3, is the front side, and the right side as seen in FIG. 3 is the rear side.

Figure 2:
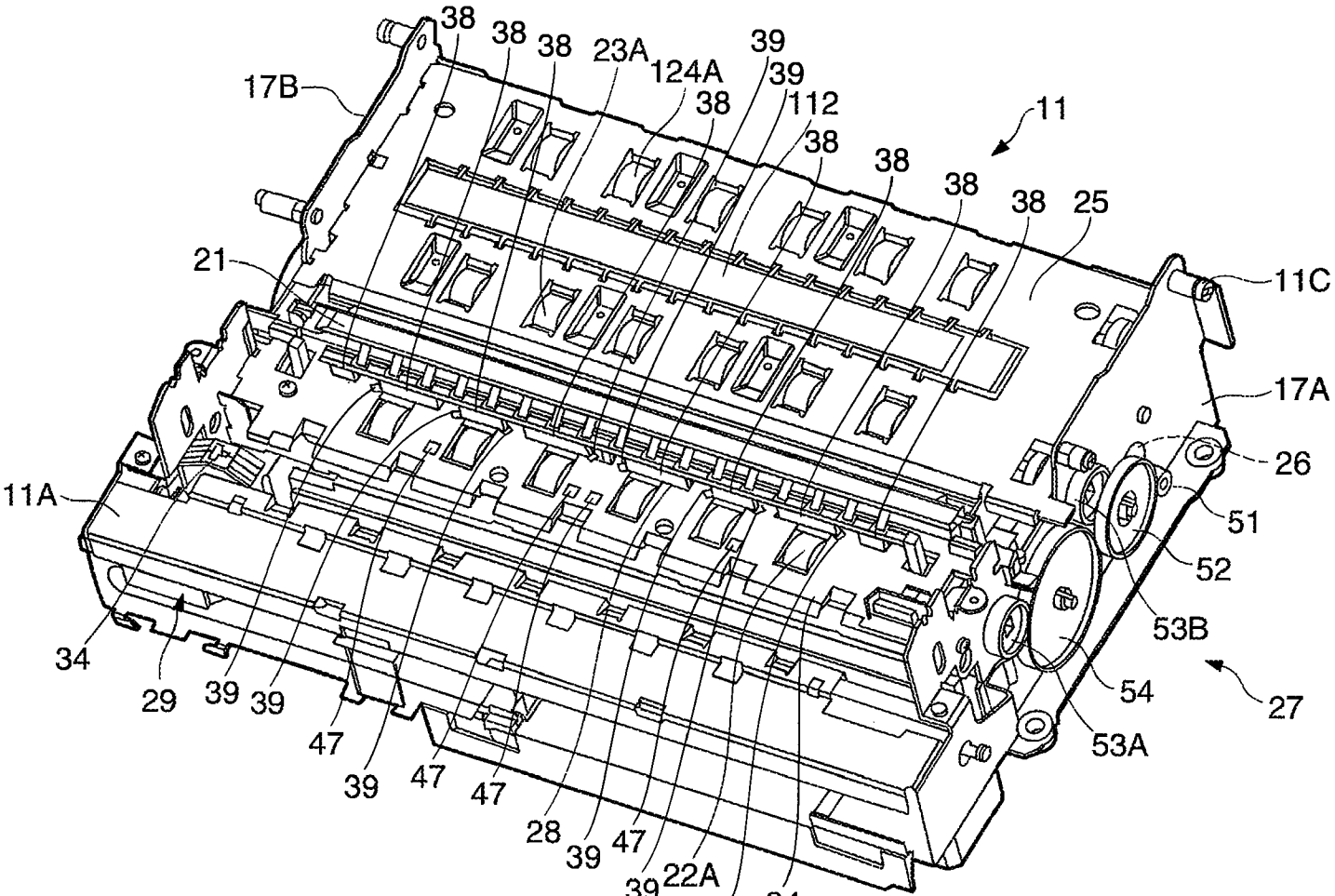
FIG. 2 is an oblique view of the printer assembly.

As shown in FIG. 2, the dot impact printer 10 has a printer assembly 11 that is covered by the top cover 12, top case 13, and bottom case 14. This printer assembly 11 includes a bottom assembly 11A and a top assembly (not shown in the figure) that is supported by pins 11C at the back end of the bottom assembly 11A. The top assembly can be pivoted by operating a lever (not shown in the figure) disposed on the left side of the top assembly to expose the inside of the printer assembly 11.

Figure 3:
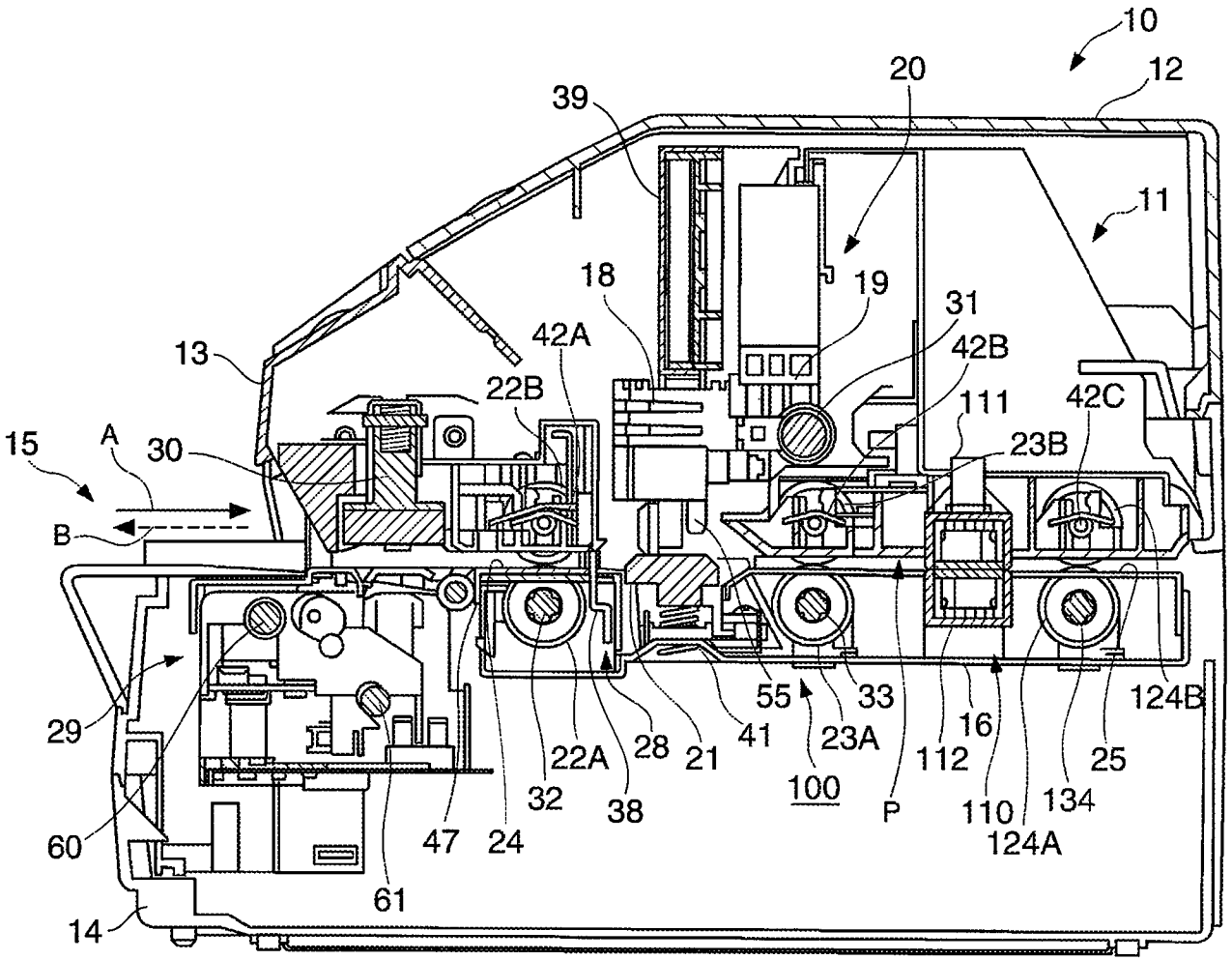
FIG. 3 is a side section view of the printer.

As shown in FIG. 2 and FIG. 3, the printer assembly 11 has a base frame 16, and a right side frame 17A and a left side frame 17B rising from fixed positions on opposite sides of the base frame 16. The side frames (not shown in the figure) of the top assembly are on the outside of these side frames 17A and 17B, and a carriage guide shaft 31 spans the gap between the side frames of the top assembly. Disposed at fixed positions between the side frames 17A and 17B are a front media guide 24 and rear media guide 25. A flat platen 21 is disposed between the front media guide 24 and rear media guide 25, and a recording head 18 is disposed above the platen 21 so that it opposes the platen 21.

The recording head 18 is carried on a carriage 19, which is disposed freely slidably on the carriage guide shaft 31. The carriage 19 is driven by the forward or reverse rotation of a carriage drive motor 56 (see FIG. 4) that drives the carriage 19 through an intervening timing belt (not shown in the figure), and is moved bi directionally guided by the carriage guide shaft 31.

The carriage 19 moves in the direction of arrow X in FIG. 1, that is, the main scanning direction, which is aligned with the axial direction of the carriage guide shaft 31 and the long side of the platen 21. The range of carriage 19 movement (scanning) is between the pair of top assembly side frames. The direction perpendicular to the main scanning direction X of the carriage 19, that is, the direction indicated by arrow Y in FIG. 1, is the sub-scanning direction.

While the recording head 18 carried on the carriage 19 travels in the main scanning direction with the carriage 19, recording wires are pushed out from the wire face (not shown in the figure) on the distal end thereof opposite the platen 21 to strike the ink ribbon, push the ink ribbon against the recording medium S conveyed between the platen 21 and the recording head 18, and record an image, which may include text, on the recording medium S. The ink ribbon is stored folded together inside a ribbon cartridge (not shown in the figure) that is mounted on the main frame or the carriage 19, and is delivered to the recording head 18 while the carriage 19 scans the recording medium. As shown in FIG. 3, a media width sensor 55 is disposed behind the recording head 18 at a position above the platen 21. The media width sensor 55 is mounted on the carriage 19 and travels with the carriage 19 over the platen 21, and is used to determine the positions of the side edges of the recording medium S and the width of the recording medium S.

As shown in FIG. 2 and FIG. 3, the platen 21 is flat and extends in the scanning direction of the carriage 19, and the ends of the platen 21 are urged toward the recording head 18 and supported elastically by an urging spring 41. The urging spring 41 is a compression spring, and the striking force of the recording wires during the recording operation of the recording head 18 is assisted by the urging force of the urging spring 41. When the thickness of the recording medium S varies while the recording medium S is conveyed, or when recording media S of different thicknesses are conveyed to the printer assembly 11, the platen 21 is pushed by the distal end of the recording head 18 in resistance to the urging force of the urging spring 41 and moves away from the recording head 18. As a result, the gap between the distal end of the recording head 18 and the recording surface of the recording medium S is held constant regardless of the thickness of the recording medium.

As shown in FIG. 3, the printer assembly 11 includes a media transportation mechanism (transportation means) 100 that conveys the recording medium S, an alignment mechanism 28 that contacts the leading end of the recording medium S conveyed by the media transportation mechanism 100 and aligns the recording medium S, a magnetic data reading unit 29 having a magnetic head 34 (see FIG. 2) that reads the MICR information printed on a check or reads or writes magnetic information to the magnetic stripe on a passbook, and a media pressure unit 30 that pushes down on the recording medium S to prevent the recording medium S from lifting up during magnetic information processing, including when the magnetic head 34 of the magnetic data reading unit 29 reads the MICR information.

The printer assembly 11 also has an optical reader 110 that reads the surface of the recording medium S. This optical reader 110 has a first scanner 111 that reads information printed on the top surface of the recording medium S, and a second scanner 112 that is disposed opposite the first scanner 111 and reads information printed on the bottom surface of the recording medium S. Both the first scanner 111 and second scanner 112 are optical image scanners, and have, for example, a lighting unit (not shown in the figure) that emits visible white light from a fluorescent tube or LED onto the reading area of the recording medium S, a plurality of photo detection sensors (not shown in the figure) that are arrayed in a line in the main scanning direction (X direction), and an output unit (not shown in the figure) that outputs signals from the photo detection sensors in a specific order.

As shown in FIG. 2 and FIG. 3, the media transportation mechanism 100 includes the platen 21, a first drive roller 22A, a first follower roller 22B, a second drive roller 23A, a second follower roller 23B, a third drive roller 124A, a third follower roller 124B, the front media guide 24, the rear media guide 25, a media transportation motor 26, and a drive wheel train 27. A transportation path P through which the recording medium S is conveyed is formed on the front media guide 24 and rear media guide 25.

In this embodiment of the invention the first drive roller 22A and first follower roller 22B are disposed on the front side of the printer assembly 11 relative to the platen 21 and recording head 18, and the second drive roller 23A and second follower roller 23B pair, and third drive roller 124A and third follower roller 124B pair, are disposed sequentially on the rear side of the printer assembly 11 relative to the platen 21 and recording head 18.

The first scanner 111 and second scanner 112 of the optical reader 110 are disposed between the second drive roller 23A and second follower roller 23B pair and the third drive roller 124A and third follower roller 124B pair.

The first drive roller 22A and first follower roller 22B are disposed as a roller pair one above the other, the second drive roller 23A and second follower roller 23B are disposed as a roller pair one above the other, and the third drive roller 124A and third follower roller 124B are disposed as a roller pair one above the other.

The first drive roller 22A, second drive roller 23A, and third drive roller 124A are drive rollers that are driven rotationally by the media transportation motor 26 and drive wheel train 27. The first follower roller 22B, second follower roller 23B, and third follower roller 124B are follower rollers that are urged by springs 42A, 42B, and 42C with specific pressure to the first drive roller 22A, second drive roller 23A, and third drive roller 124A side, respectively. As a result, the first drive roller 22A and first follower roller 22B are rotationally driven in mutually opposite directions, the second drive roller 23A and second follower roller 23B are rotationally driven in mutually opposite directions, and the third drive roller 124A and third follower roller 124B are rotationally driven in mutually opposite directions.

The drive wheel train 27 is disposed on the outside of the right side frame 17A as shown in FIG. 2. The drive wheel train 27 has a motor pinion 51 that is affixed to rotate in unison with the drive shaft of the media transportation motor 26, which can rotate in forward and reverse directions. Drive power from the motor pinion 51 is transferred through a speed reducing gear 52 to a second drive gear 53B affixed to the second roller shaft 33 of the second drive roller 23A, and is transferred from this second drive gear 53B through an intermediate gear 54 to a first drive gear 53A affixed to the first roller shaft 32 of the first drive roller 22A.

Torque from the second roller shaft 33 of the second drive roller 23A is transferred to the third roller shaft 134 of the third drive roller 124A by a drive belt (not shown in the figure), for example. As a result, the first drive roller 22A, second drive roller 23A, and third drive roller 124A shown in FIG. 3 rotate in the same direction and can convey the recording medium S into the printer assembly 11. More specifically, when the media transportation motor 26 rotates forward, the first drive roller 22A, second drive roller 23A, and third drive roller 124A shown in FIG. 3 convey the recording medium S in the sub-scanning direction inside the printer assembly 11 as denoted by arrow A in the figure, and convey the recording medium S in the direction in which it is discharged from the printer assembly 11 as indicated by arrow B in the figure when the media transportation motor 26 turns in reverse.

The alignment mechanism 28 aligns the recording medium S before the recording head 18 prints on the recording medium S and before the optical reader 110 scans the recording medium S. The alignment mechanism 28 includes a plurality (eight in this embodiment of the invention) of alignment plates (alignment members) 38 and an alignment plate motor 65 (see FIG. 4) that drives the alignment plates 38. The alignment plates 38 are disposed between the first drive roller 22A and first follower roller 22B and the recording head 18 and platen 21, and can move to a forward position intervening in the transportation path P, and a retracted position removed from the transportation path P. As shown in FIG. 2, the alignment plates 38 are arrayed across the width of the transportation path P (in the main scanning direction of the carriage 19), change the orientation of the recording medium S as a result of the recording medium S being driven against the alignment plates 38, and can align the recording medium S.

The printer assembly 11 has a plurality of media detection sensors 39 that detect the presence of the recording medium S driven in contact with the alignment plates 38. The media detection sensors 39 are disposed in the transportation path P near the upstream side of the alignment plates 38 (beside each of the alignment plates 38 in this embodiment of the invention) as shown in FIG. 2. The media detection sensors 39 are transmissive sensors including a light-emitting unit (such as an LED) and a photodetection unit (such as a phototransistor) disposed with the transportation path P therebetween, and detect whether a recording medium S is present based on whether the light emitted from the light-emitting unit is detected by the photodetection unit, or is blocked by the recording medium S.

Because the media detection sensors 39 are disposed at substantially equal intervals along the alignment plates 38, whether or not the angle of the recording medium S relative to the transportation direction after alignment by the alignment plates 38 is within an allowed skew range can be determined based on the output (detection results) of the media detection sensors 39. For example, alignment is determined to be completed if any two adjacent media detection sensors 39 of the media detection sensors 39 arrayed across the width of the transportation path P (in the main scanning direction of the carriage 19) simultaneously detect the recording medium S.

The printer assembly 11 also has a plurality (four in this embodiment of the invention) of insertion detection sensors 47 that detect insertion of a recording medium S into the transportation path P in front of the first drive roller 22A as shown in FIG. 2. The insertion detection sensors 47 are reflective sensors having a light-emitting unit that emits light toward the transportation path P and a photodetection unit that detects its reflection. Note that a transmissive sensor having a light-emitting unit and a photodetection unit disposed with the transportation path P therebetween may also be used as the insertion detection sensor. This configuration determines that a recording medium S was inserted into the transportation path P when the photodetection units of all insertion detection sensors 47 sense light and then photodetection by any one of the insertion detection sensors 47 is blocked.

Figure 4:
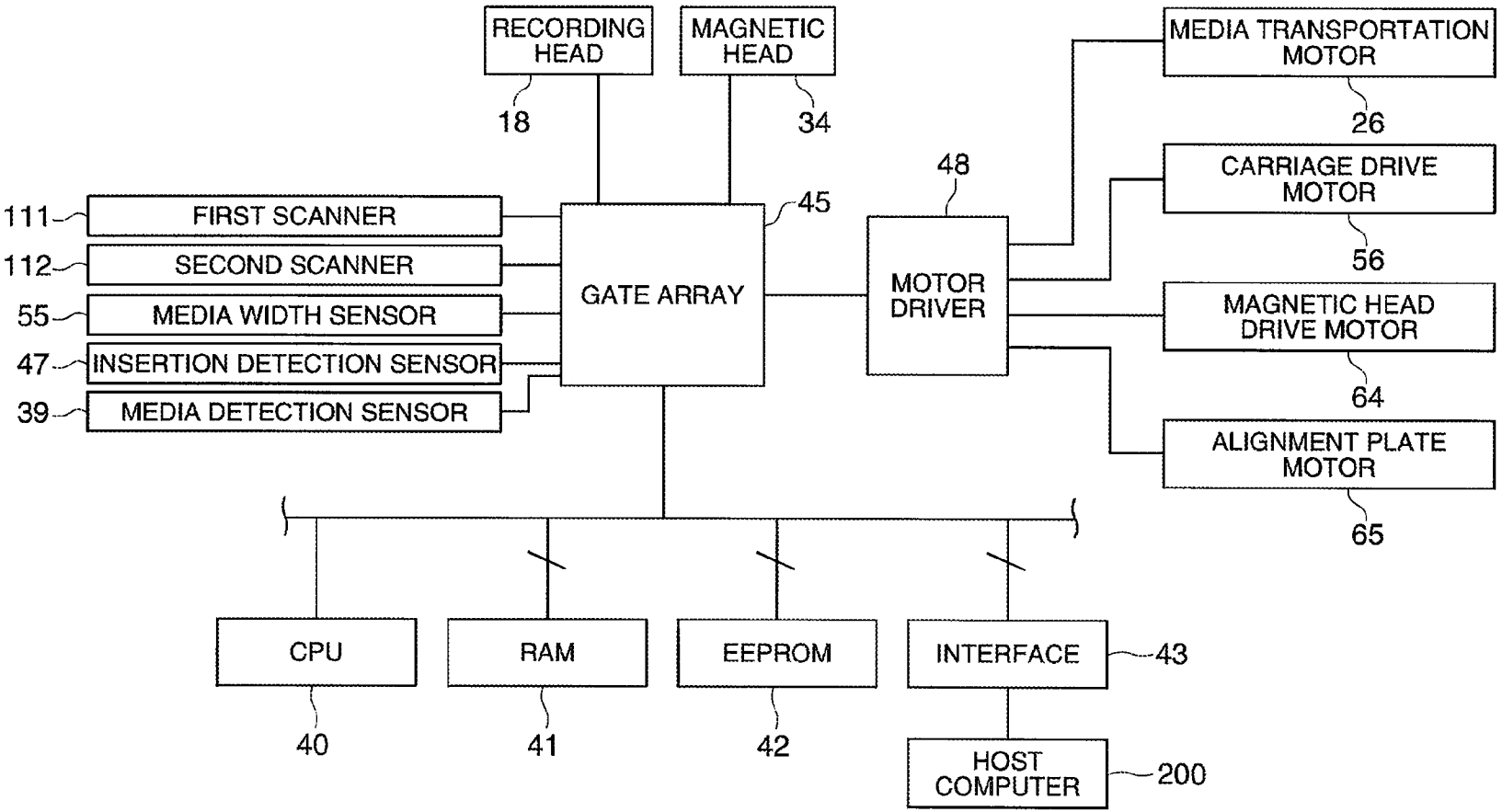
FIG. 4 is a block diagram showing the functional configuration of the dot impact printer.

FIG. 4 is a block diagram showing the functional configuration of the dot impact printer 10.

The dot impact printer 10 has a CPU (control means) 40 that controls overall operation of the dot impact printer 10 based on a control program, EEPROM 42 that stores the control program executed by the CPU 40 and processed data, RAM 41 that temporarily stores data and the control program read from EEPROM 42 by the CPU 40, and an interface 43 that converts the data format when sending and receiving data with the host computer 200 that controls the dot impact printer 10.

The recording head 18 and magnetic head 34 are connected to the CPU 40 through a gate array 45. The gate array 45 outputs drive current to the recording head 18 as controlled by the CPU 40 to drive the recording wires to print. The gate array 45 also outputs a reading current to the magnetic head 34 to read the magnetic information as controlled by the CPU 40, and digitizes and outputs to the CPU 40 the signal current input from the magnetic head 34.

The media detection sensors 39, insertion detection sensor 47, media width sensor 55, first scanner 111, and second scanner 112 described above are connected to the gate array 45. The media detection sensor 39, insertion detection sensor 47, and media width sensor 55 operate according to drive current input from the gate array 45, and output an analog voltage corresponding to detection values to the gate array 45. The gate array 45 quantizes the analog voltages input from the insertion detection sensor 47 and media width sensor 55, and outputs the resulting digital data to the CPU 40.

The first scanner 111 reads and supplies information printed on the top surface of the recording medium S (the surface on the opposite side as the surface on which the magnetic information is printed, for example) to the gate array 45. The second scanner 112 reads and supplies information printed on the bottom surface of the recording medium S (the surface on which magnetic information is printed, for example) to the gate array 45.

The gate array 45 quantizes the analog voltages supplied from the first scanner 111 and second scanner 112, and outputs the resulting digital data to the CPU 40.

A motor driver 48 is connected to the gate array 45. The motor driver 48 is connected to the media transportation motor 26, the carriage drive motor 56, a magnetic head drive motor 64, and an alignment plate motor 65, supplies drive current or drive pulses to these motors, and causes the motors to operate.

Based on a control program stored in EEPROM 42, the CPU 40 controls the recording head 18 and motor driver 48 through the gate array 45, and acquires detection results from the media detection sensors 39, insertion detection sensors 47, and media width sensor 55.

The CPU 40 also drives the media transportation motor 26 to convey the recording medium S in the sub-scanning direction indicated by arrow Y (see FIG. 1), drives the carriage drive motor 56 to drive the carriage 19 in the main scanning direction indicated by arrow X (see FIG. 1), and drives the magnetic head drive motor 64 to drive a magnetic head unit 62 in the main scanning direction indicated by arrow X. The CPU 40 also controls the gate array 45 to drive the recording head 18 and cause the recording wires to strike the ink ribbon, process magnetic information by means of the magnetic head 34, or read information printed on the surface of the recording medium S by means of the first scanner 111 and second scanner 112.

A dot impact printer 10 configured as described above is installed at a teller window in a bank or other financial institution, and is used when processing transactions using a check as the recording medium S. More specifically, when the recording medium S is inserted in the manual insertion opening 15, the recording medium S is gripped by the first drive roller 22A and first follower roller 22B, and is conveyed in the direction of arrow A to a position just before the platen 21. To correct skewing of the recording medium S relative to the transportation direction, the alignment plates 38 protrude into the transportation path P of the recording medium S. Recording medium S skew is corrected and the recording medium S is aligned by continuing to convey the recording medium S after it contacts the alignment plate 38.

The alignment plates 38 then retract from the transportation path P, the recording medium S is conveyed to a range where width detection by the media width sensor 55 is possible, and the position of the recording medium S is detected by the media width sensor 55 while the carriage 19 is moved in the main scanning direction. The recording medium S is then conveyed to a position where the MICR data area MA, where the magnetic information is recorded can be read by the magnetic data reading unit 29. The magnetic head 34 of the magnetic head unit 62 then reads the magnetic information encoded in the MICR data on the recording medium S by driving the magnetic head drive motor 64 of the magnetic data reading unit 29 and moving the magnetic head unit 62 supported by the magnetic head guide shafts 60, 61 in the main scanning direction indicated by arrow X (see FIG. 1).

Note that the position of the recording medium S detected by the media width sensor 55 is referenced at this time to scan a suitable area. The information read by the magnetic head 34 is then digitized by the gate array 45 and output to the CPU 40. Based on the data supplied from the gate array 45, the CPU 40 analyzes and converts the character information to text data. If the character information recorded as MICR data can be analyzed, the acquired text data is sent to the host computer 200.

The recording medium S is next conveyed to the position of the first scanner 111 and second scanner 112. The top and bottom surfaces of the recording medium S are then optically scanned, and the acquired information is converted to digital image data by the gate array 45 and supplied to the CPU 40. The CPU 40 sends the supplied image data for the top and bottom surfaces to the host computer 200. The host computer 200 then processes the payment electronically by sending the received image data from the payee bank to the payer bank instead of physically transporting and processing the actual check.

When the first scanner 111 and second scanner 112 finish the scanning process, the recording medium S is conveyed to the recording position on the platen 21. Based on the magnetic information read by the magnetic data reading unit 29, information indicating that the check has been used, for example, is recorded on the recording surface of the recording medium S while the recording head 18 and carriage 19 move in the main scanning direction. Finally, the recording medium S is conveyed in the direction of arrow B (see FIG. 1 by the first drive roller 22A and first follower roller 22B, and the recording medium S is discharged from the manual insertion opening 15.

In order to verify the person presenting a check when payments are processed electronically using a check as the recording medium S, an identification (ID) card (medium) may be inserted after the check is processed from the manual insertion opening 15 of the dot impact printer 10 after the check is processed, and the information displayed on the ID card may be scanned by the first scanner 111 and second scanner 112 of the optical reader 110 and stored as image data. In this situation, the ID card is preferably aligned by the alignment plates 38 in a similar way a check is aligned so that the ID card may be scanned in an aligned, unskewed position by the optical reader 110.

If, for example, the ID card is laminated and has a transparent part (a part with high transmittance) at the leading end (edge part) thereof, the media detection sensor 39 will not be able to determine that the ID is aligned even though alignment by the alignment plates 38 is completed because the light from the media detection sensor 39 will pass through this transparent part, and the scanning process of the optical reader 110 can therefore be expected to remain idle. This embodiment of the invention therefore enables the determination of alignment of such an ID card by means of a simple configuration, and prevents the scanning process of the optical reader 110 from remaining idle.

Figure 5:
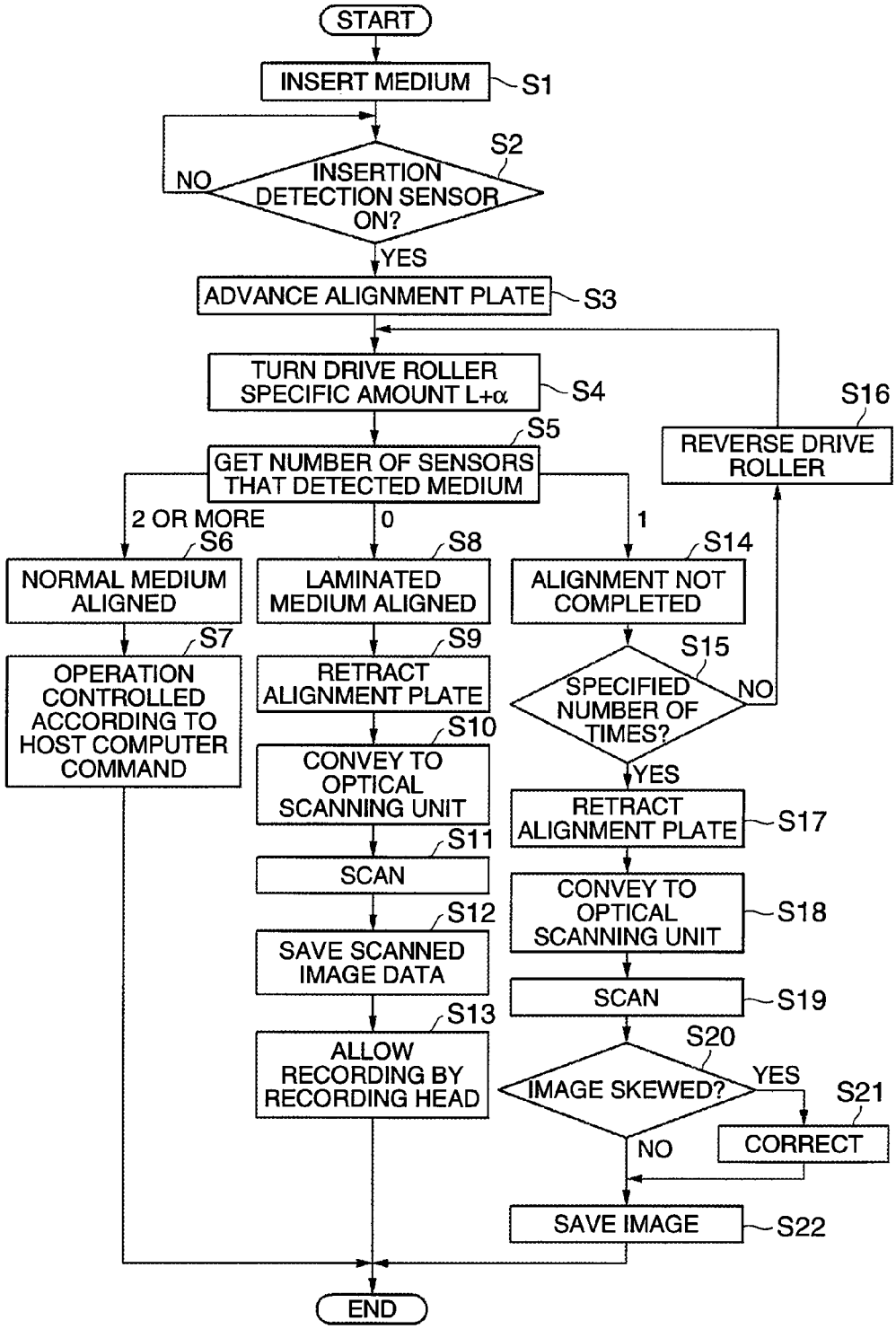
FIG. 5 is a flow chart describing the operation of the dot impact printer.
Figure 6:
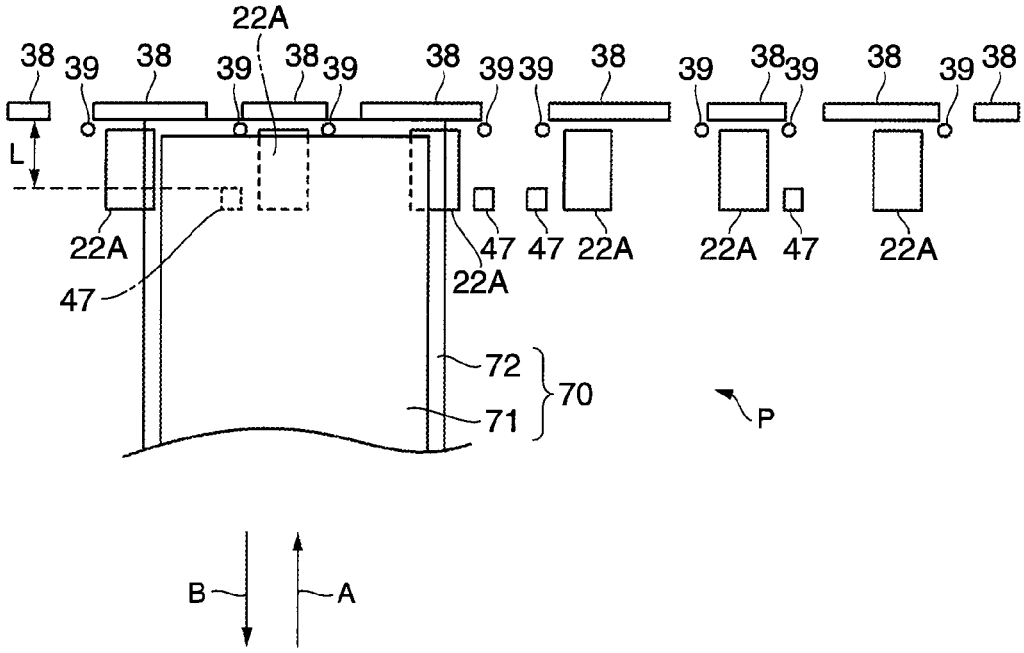
FIG. 6 schematically describes the alignment detection operation when a medium with a transparent edge part is inserted.

The operation of the dot impact printer when a medium is inserted therein is described next. FIG. 5 is a flow chart describing the operation of the dot impact printer, and FIG. 6 schematically describes the alignment detection operation when an ID card is inserted.

When a medium is manually inserted into the manual insertion opening 15 of the dot impact printer 10 (step S1), the CPU 40 determines whether the insertion detection sensor 47 detects the medium (step S2). More specifically, the CPU 40 determines that the medium was inserted when the photodetection unit of at least one insertion detection sensor 47 cannot sense light from the light-emitting unit.

If the insertion detection sensor 47 does not detect the presence of the medium (step S2 returns No), this process repeats until the medium is detected.

If the insertion detection sensor 47 detects the medium S (step S2 returns Yes), the CPU 40 drives the alignment plate motor 65 and moves the alignment plates 38 into the transportation path P (step S3), and drives the media transportation motor 26 to make the first to third drive rollers 22A to 124A turn and convey the medium a specific amount L+· along the transportation path P (step S4).

This specific amount L+· is a distance sufficient to drive the medium against the alignment plates 38 and align the medium. More specifically, as shown in FIG. 6, the distance L from the insertion detection sensor 47 to the alignment plate 38 is predetermined according to the particular device, and the specific amount L+· is set by adding to this distance L a specific amount · that is determined experimentally and set as the distance whereby the medium skew is corrected.

The CPU 40 then determines the number of media detection sensors 39 that detected the medium in contact with the alignment plates 38 (step S5). With this configuration the type of medium and whether alignment is completed can be clearly determined from the number of sensors that detect the medium.

If at least two sensors detect the medium, the CPU 40 determines that the medium is a normal recording medium and alignment of this recording medium by the alignment plate 38 is completed (step S6). As a result, the CPU 40 waits for a signal from the host computer 200 described above, controls the operation of the dot impact printer 10 based on this signal (step S7), and ends the process.

However, if the number of sensors detecting the medium is 0, the CPU 40 determines that the medium is a laminated medium (such as an ID card) 70 and alignment of the ID card 70 by the alignment plate 38 is completed (step S8).

In this situation the ID card 70 is made by laminating a card 71 and has a transparent edge part (leading end) 72 around the outside. Because of the high transmittance of this edge part 72, the presence of the medium is not detected by the media detection sensors 39, but because the medium is conveyed a distance sufficient for alignment in step S4, the CPU 40 can identify the medium as being a medium with a high transmittance portion at the edge part (leading end) thereof. As a result, even when the medium is a laminated ID card 70, for example, alignment of the ID card 70 can be determined using a simple configuration and without complicating the device configuration by using the detection results from the media detection sensors 39.

The CPU 40 then processes the ID card 70 or other laminated medium. More specifically, the CPU 40 drives the alignment plate motor 65 and retracts the alignment plates 38 from the transportation path P (step S9), and drives the media transportation motor 26 to rotate the first to third drive rollers 22A to 124A and convey the medium to the optical reader 110 on the downstream side of the alignment plates 38 (step S10). As a result, the medium is prevented from remaining idle at the alignment plate 38 as happens with the related art, and processing can proceed quickly.

The CPU 40 then scans all of the top and bottom surfaces of the ID card 70 by means of the first scanner 111 and second scanner 112 of the optical reader 110 (step S11). Because the ID card 70 is aligned by the alignment plates 38 and the aligned ID card 70 is then scanned by the first scanner 111 and second scanner 112 of the optical reader 110 when the ID card 70 is inserted from the manual insertion opening 15 in this configuration, the entire process of aligning and reading the medium can be executed quickly.

The scanned image data is then sent to the host computer 200 and stored by the host computer 200 (step S12). Because user information identifying the person presenting a check for electronic processing is thus stored with the check in the host computer, the identity of the person presenting the medium can be reliably checked.

The CPU 40 then allows the recording of an image on the ID card 70 (step S13). When an image recording signal is sent from the host computer 200, the CPU 40 controls operation based on the signal and then ends the process.

Because recording an image on the ID card 70 is enabled with this configuration, an image can be easily recorded on the ID card 70 even if the ID card 70 is laminated by providing a recordable area on the ID card 70, for example. In addition, because an image is not recorded on the ID card 70 if the medium is conveyed skewed, problems recording an image on the ID card 70 can be prevented.

If the number of sensors detecting the medium is one, the CPU 40 determines the medium alignment process is not completed (step S14) and then determines if the medium alignment detection operation was executed less than a specified number of times (such as 3 times) (step S15). If this number is less than the specified number (step S15 returns No), the CPU 40 drives the media transportation motor 26 in reverse and conveys the medium in direction B (FIG. 6) (step S16). Control then returns to step S4 and the medium alignment process repeats. Because slight skewing of the medium can be removed by thus repeating the medium alignment process, this configuration can quickly execute the alignment process.

If the specified number has been reached (step S15 returns Yes), the CPU 40 drives the alignment plate motor 65 and retracts the alignment plates 38 from the transportation path P (step S17), and drives the media transportation motor 26 to turn the first to third drive rollers 22A to 124A and convey the medium to the optical reader 110 on the downstream side of the alignment plates 38 (step S18).

The CPU 40 then scans all of the top and bottom surfaces of the medium using the first scanner 111 and second scanner 112 of the optical reader 110 (step S19), and determines if the scanned image data is skewed (step S20). More specifically, whether the image data is skewed can be determined based on whether or not the edges of the scanned image data and the lines of text are aligned with the sub-scanning direction. The reason why the image data is skewed, such as because the medium is actually skewed or because transmittance is reduced because part of the edge of the ID card is soiled, can therefore be determined from the scanned image data. Therefore, the accuracy of alignment detection by the media detection sensors 39 does not need to be greater than necessary, and the device configuration and alignment detection process can be simplified.

If it is thus determined that the scanned image data is skewed (step S20 returns Yes), the CPU 40 corrects image data skew so that the image data is aligned with the sub-scanning direction (step S21), and stores the image data in RAM 41 (step S22).

However, if the scanned image data is not skewed (step S20 returns No), the CPU 40 stores the image data directly to RAM 41 and ends the process.

A situation in which the ID card 70 is inserted immediately after a check is inserted as the recording medium S is described above, but the ID card 70 may be inserted independently.

In addition, an ID card 70 is used as an example of a medium having a high transmittance part at the leading end thereof, but the invention can be used with any medium having a transparent leading end and is obviously not limited to ID cards 70.

Yet further, this embodiment of the invention is described with reference to a dot impact printer 10, but the invention is not so limited and may be used with an inkjet printer or a thermal printer that heats a thermosensitive medium to record an image. Particularly with a thermal printer, it is not necessary to set aside an area for recording an image in order to record an image on the surface of a laminated card, and the freedom of the recording operation can be improved.

Yet further, the specific configuration of the insertion detection sensors 47 and the media width sensor 55 is also not limited, the function blocks shown in the block diagram in FIG. 4 can be implemented by the cooperation of hardware and software, the specific configuration of the hardware and the specifications of the software are also not limited, and other detailed aspects of the configuration can be changed as desired.

In addition, the invention is not limited to devices used as a stand-alone printer, such as a dot impact printer 10, and may be incorporated in another device, such as an ATM (automated teller machine) or CD (cash dispenser), and may be applied to a wide range of devices.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A transportation alignment device having a transportation means that conveys a medium, and an alignment member that can move to a forward position intervening in a transportation path of the medium and a retracted position retracted from the transportation path, the transportation alignment device causing a leading end of the medium to contact the alignment member, thereby aligning the medium, said alignment device comprising:

a plurality of optical media detection sensors arranged across a width of the transportation path on an upstream side of the alignment member, each of said plurality of optical media detection sensors detecting a leading end part of the medium touching the alignment member; and a control means that, when the medium is conveyed a specific amount sufficient to contact the alignment member and align the medium and all of the media detection sensors do not detect the medium, determines the medium is a medium having an edge part with higher transmittance than a part other than the edge part, retracts the alignment member from the transportation path, and conveys the medium to a downstream side of the transportation path.

2. The transportation alignment device described in claim 1, further comprising:

an optical scanning unit that optically reads a surface of the medium at a position on the transportation path downstream from the alignment member;

wherein the control means reads a surface of the medium with the optical scanning unit.

3. The transportation alignment device described in claim 1, further comprising:

an optical scanning unit that optically reads a surface of the medium at a position on the transportation path downstream from the alignment member;

wherein when the medium is conveyed a specific amount sufficient to align the medium in contact with the alignment member and only one of the media detection sensors detects the medium, the control means controls retracting the alignment member from the transportation path and conveying the medium to the downstream side of the transportation path, reading a surface of the medium by the optical scanning unit, and determining based on a captured image if the medium is aligned.

4. The transportation alignment device described in claim 1, wherein:

when only one media detection sensor detects the medium, the control means drives the transportation means and repeats medium alignment a specific number of times.

5. The transportation alignment device described in claim 1, further comprising:

a recording means that records an image on the medium at a position on the transportation path downstream from the alignment position of the alignment member;

wherein when the medium is aligned, the control means permits recording an image on the medium by the recording means.

6. The transportation alignment device described in claim 1, wherein:

the plurality of optical media detection sensors are arranged at equal intervals.

7. The transportation alignment device described in claim 6, wherein:

when two or more of the plurality of optical media detection sensors detect the medium, the medium is determined to be a paper medium and alignment of the paper medium by the alignment member is determined to be completed.

8. The transportation alignment device described in claim 1, further comprising:

an insertion detection sensor that detects insertion of the medium to the transportation path;

wherein when the insertion detection sensor detects the medium, the control means moves the alignment member into the transportation path, causes the leading end of the medium to contact the alignment member, and aligns the medium.

9. A control method for a transportation alignment device that has a transportation means that conveys a medium, and an alignment member that can move to a forward position intervening in a transportation path of the medium and a retracted position retracted from the transportation path, said transportation alignment device causes a leading end of the medium to contact the alignment member and aligns the medium, wherein the control method:

detects a leading end part of the medium touching the alignment member using a plurality of optical media detection sensors arranged across the width of the transportation path on the upstream side of the alignment member when the medium is conveyed a specific amount sufficient to contact the alignment member and align the medium; and when all of the optical media detection sensors do not detect the medium, determines that the medium is a medium having an edge part with higher transmittance than a part other than the edge part, and retracts the alignment member from the transportation path and conveys the medium to a downstream side of the transportation path.

10. A control method for the transportation alignment device described in claim 9, wherein:

the plurality of optical media detection sensors are arranged at equal intervals.

11. A control method for the transportation alignment device described in claim 9, wherein:

when two or more of the plurality of optical media detection sensors detect the medium, the medium is determined to be a paper medium and alignment of the paper medium by the alignment member is determined to be completed.

12. A recording device comprising:

a transportation means that conveys a medium;

an alignment member that can move to a forward position intervening in a transportation path of the medium and a retracted position retracted from the transportation path;

a recording means that records an image on the medium aligned by the alignment member;

a plurality of optical media detection sensors arranged across a width of the transportation path on an upstream side of the alignment member, each of said optical media detection sensors detecting a leading end part of the medium touching the alignment member; and a control means that, when the medium is conveyed a specific amount sufficient to contact the alignment member and align the medium and all of the optical media detection sensors do not detect the medium, determines the medium is a medium having an edge part with higher transmittance than a part other than the edge part, and retracts the alignment member from the transportation path and conveys the medium to a downstream side of the transportation path.

13. A recording device described in claim 12, further comprising:

an insertion detection sensor that detects insertion of the medium to the transportation path;

wherein when the insertion detection sensor detects the medium, the control means moves the alignment member into the transportation path, causes the leading end of the medium to contact the alignment member, and aligns the medium.

14. A transportation alignment device having a transportation mechanism that conveys a medium, and an alignment member that can move to a forward position intervening in a transportation path of the medium and a retracted position retracted from the transportation path, the transportation alignment device causing a leading end of the medium to contact the alignment member, thereby aligning the medium, said alignment device comprising:

a plurality of optical media detection sensors arranged across a width of the transportation path on an upstream side of the alignment member, each of said plurality of optical media detection sensors detecting a leading end part of the medium touching the alignment member; and a CPU that, when the medium is conveyed a specific amount sufficient to contact the alignment member and align the medium and all of the media detection sensors do not detect the medium, determines the medium is a medium having an edge part with higher transmittance than a part other than the edge part, retracts the alignment member from the transportation path and conveys the medium to a downstream side of the transportation path.

15. A control method for a transportation alignment device that has a transportation mechanism that conveys a medium, and an alignment member that can move to a forward position intervening in a transportation path of the medium and a retracted position retracted from the transportation path, said transportation alignment device causes a leading end of the medium to contact the alignment member and aligns the medium, wherein the control method:

detects a leading end part of the medium touching the alignment member using a plurality of optical media detection sensors arranged across the width of the transportation path on the upstream side of the alignment member when the medium is conveyed a specific amount sufficient to contact the alignment member and align the medium; and when all of the optical media detection sensors do not detect the medium, determines that the medium is a medium having an edge part with higher transmittance than a part other than the edge part, and retracts the alignment member from the transportation path and conveys the medium to a downstream side of the transportation path.

16. A recording device comprising:

a transportation mechanism that conveys a medium;

an alignment member that can move to a forward position intervening in a transportation path of the medium and a retracted position retracted from the transportation path;

a plurality of optical media detection sensors arranged across a width of the transportation path on an upstream side of the alignment member, each of said optical media detection sensors detecting a leading end part of the medium touching the alignment member; and a CPU that, when the medium is conveyed a specific amount sufficient to contact the alignment member and align the medium and all of the optical media detection sensors do not detect the medium, determines the medium is a medium having an edge part with higher transmittance than a part other than the edge part, and retracts the alignment member from the transportation path and conveys the medium to a downstream side of the transportation path.

* * * * *